United States Patent [19]

Berger et al.

[11] Patent Number: 4,757,680

[45] Date of Patent: Jul. 19, 1988

[54] SPINNING INSTALLATION FOR MAKING CORE SPUN YARNS

[75] Inventors: Henri Berger, St Germain De L'Espinasse; Michel Clement; Marcel Schoumacher, both of Roanne, all of France

[73] Assignee: Rovatex, Courbevoie, France

[21] Appl. No.: 877,746

[22] Filed: Jun. 24, 1986 (Under 37 CFR 1.47)

[30] Foreign Application Priority Data

Jun. 25, 1985 [FR] France ..... 85 09973

[51] Int. Cl.[4] ..... D01H 5/28; D02G 3/36; D02G 3/38

[52] U.S. Cl. ..... 57/328; 57/5; 57/6; 57/12

[58] Field of Search ..... 57/5, 6, 12, 293, 328

[56] References Cited

U.S. PATENT DOCUMENTS

| | | | |
|---|---|---|---|
| 4,351,146 | 9/1982 | Faure et al. | 57/328 X |
| 4,364,225 | 12/1982 | Faure | 57/293 X |
| 4,488,397 | 12/1984 | Venot | 57/328 |
| 4,489,540 | 12/1984 | Faure et al. | 57/5 |
| 4,545,194 | 10/1985 | Juillard | 57/328 X |
| 4,584,830 | 4/1986 | Faure et al. | 57/328 |

*Primary Examiner*—John Petrakes
*Attorney, Agent, or Firm*—Parkhurst & Oliff

[57] ABSTRACT

This invention relates to a spinning installation for making fiber spun yarns, the yarns comprising a central core of discontinuous fibers covered with an external sheath also of discontinuous fibers. The fibers forming the core and the sheath come from a common drawing system at the outlet of which they are projected onto two condenser elements. The assembly is subjected to the action of a false twist spindle. The condenser element on which the fibers forming the core are projected comprises a rotary guide associated with a mobile roller which blocks the extension of twist communicated by the false twist spindle.

6 Claims, 7 Drawing Sheets

SPINNING INSTALLATION FOR MAKING CORE SPUN YARNS

The present invention relates to an improvement in spinning techniques for producing fiber yarns and more particularly fiber yarns with a structure such that they have a central core of discontinuous fibers which may themselves comprise an inner core based on a continuous filament, the inner core being covered with an external sheath of discontinuous fibers, of the same nature as or of a different nature from the fibers forming the inner core.

The invention relates more particularly to an improved device for carrying out the process disclosed in French Pat. No. 84 03083 (published under No. 2 560 230), corresponding to U.S. Pat. No. 4,584,830.

The above-mentioned Patent itself relates to an improvement to French Pat. Nos. 82 01382 and 82 15830 (published respectively under Nos. 2 520 391 and 2 533 236), corresponding to U.S. Pat. No. 4,489,540). These patents describe a technique in which the fibers for forming the internal core are subjected to a false twist operation and elementary fibers are projected onto this spun yarn upstream of the false twist spindle. The projection of said elementary fibers onto the core in the zone where the twist extends back is achieved by means of a mobile guiding surface on which said fibers are delivered tangentially. The mobile guiding surface tends to exert a pulling force on the free end of said fibers, the core being displaced tangentially with respect to the above-mentioned guiding surface in a direction which is concurrent with the direction in which the fibers are brought.

According to the improvement brought by French Pat. No. 2 250 230 (corresponding to U.S. Pat. No. 4,584,830), in order to obtain such a core spun yarn, the whole fiber assembly (core and covering part) are subjected to the action of a common drawing system, i.e. either a single drawing system for all the fibers, or two systems operating simultaneously in parallel, and, at the outlet of the common drawing system:

part of the fibers for forming the cover is delivered progressively onto a mobile guiding surface on which they are maintained flat, this surface tending to exert a pulling force on the free end of said fibers;

the other part of the fibers, intended to form the core, is maintained spaced apart from said surface in order to be brought into tangential contact therewith downstream of the zone of projection of the first part of fibers onto said surface.

One of the problems raised when carrying out such a process, which is otherwise entirely satisfactory, resides in the fact that it is very difficult to obtain a fine core yarn which involves considerable drawing, and it is not possible to locate with precision the twist extension blocking point along the core yarn, this point varying as a function of the tension given to the yarn by the false twist member disposed downstream of the drawing assembly. Furthermore, according to this process, it is also a relatively delicate matter to incorporate a continuous core within the fibrous core, particularly when it is desired to reinforce the resistance of the resulting spun yarn.

A device has now been found, and this is the object of the present invention, which enables all of these problems to be solved.

The invention generally relates to a device for carrying out the process mentioned hereinabove, said device being characterized in that the fibers for forming the core are, between the outlet of the drawing system and the guiding surface where said core is associated with the covering fibers, subjected to the action of a second condenser element which includes a rotary guide and a mobile roller. The second condenser blocks the extension back of twist communicated by the false twist spindle.

The devices in accordance with the present invention make it possible to increase the drawing rate given to the fibers constituting the core, as well as to obtain very regular yarns which are perfectly identical on all the positions in the spinning installation, such yarns being perfectly reproducible in time.

Furthermore, such a device facilitates the incorporation of a continuous filament yarn within the fibers forming the core of the spun yarn, if desired, this core possibly being constituted by an extensible yarn. The second condenser element may be similar to that described in French Pat. No. 2 520 389 (corresponding to U.S. Pat. No. 4,488,397), i.e. in the form of a rotating guide with a V-shaped surface. However, the second condenser element is preferably in the form of a cylinder pierced in its median part over the whole of its periphery with orifices connected to a source of suction.

The two condenser elements used in the device according to the present invention, namely the one for bringing the fibers forming the core and the one on which the covering fibers are deposited around the core thus formed, may be placed either parallel to the drawing system or, in a preferred embodiment, at right angles thereto. In both cases, the fibers which come from the drawing system to form the core will envelope the condenser element over part of its periphery before they reach the twist blocking roller.

The twist blocking roller may be metallic, ceramic, or rubber, and will preferably be mounted with means for regulating the pressure exerted by the twist blocking roller against the surface of the condenser; the roller may, of course, be disconnectable, for example, when the machine is stopped or during an intervention.

The invention will be more readily understood on reading the following description with reference to the accompanying drawings, in which.

In the following description, for the different variant embodiments illustrated, like references will designate like elements.

Figure 1:
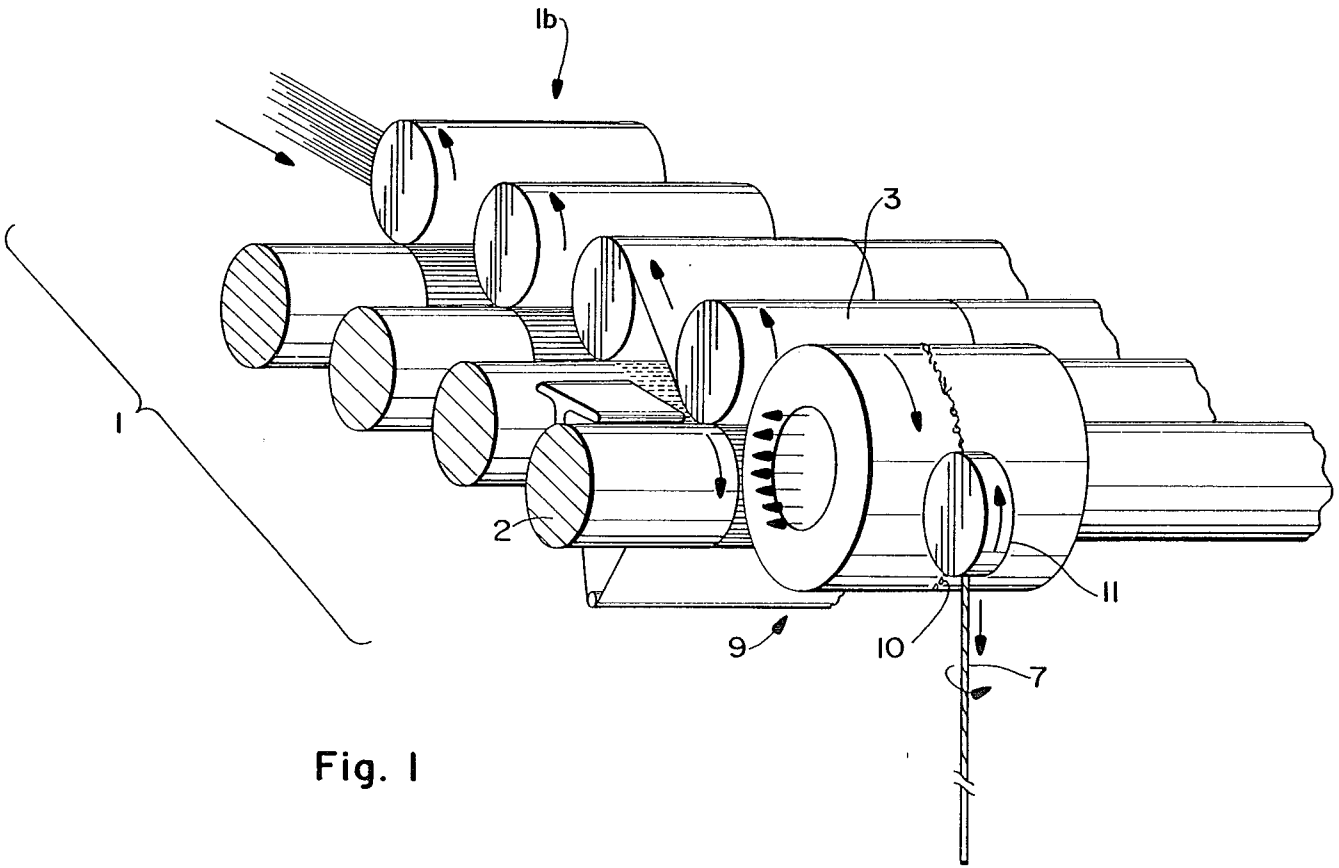
FIGS. 1 and 2 are schematic perspective and front views, respectively, of that part of the device according to the invention for producing the fibrous core on which covering fibers will be applied, this condenser device being, in this embodiment, disposed parallel to the drawing system.

Referring now to the drawings, and more particularly to FIGS. 4 to 9, the installation according to the invention essentially comprises a conventional drawing system for each work position, generally designated by reference 1 and which, in the present case, is a conventional system employing sleeves, well known to the man skilled in the art and which will therefore not be described in detail. Any other equivalent drawing system may, of course, be used.

Downstream of the last pair of drawing rollers 2, 3 of the drawing system 1 there is provided a guiding surface 4 constituted by a rotary disc, also designated by the term "condenser" and which is in the form of a hollow rotary cylinder pierced over the whole of its periphery with orifices 5. The rotary cylinder is subjected to the action of a source of suction. A false twist spindle 6 employing friction is disposed downstream of the rotary condenser guide 4. A fiber-delivery system is provided in front of the re-wind means (not shown) which are constituted, for example, by a re-wind system with tangential drive not imparting any additional twist to the spun yarn formed. Any other re-wind system possibly communicating an additional twist may, of course, be used.

In accordance with the teachings of French Pat. No. 2 560 230 (U.S. Pat. No. 4,584,830), the drawing system 1 common to the fibers for forming the core and the cover of the core spun yarn to be made, is constituted by two sleeve systems 1*a*, 1*b* operating in parallel, a device currently used in the spinning of fibers. System 1*a* delivers the fibers for forming the cover whilst the other system 1*b* delivers the fibers for forming the core. The fibers coming from system 1*a* are delivered onto the rotary guiding surface (or condenser) 4, and wrap around at least a portion of this surface, whilst the other fibers coming from system 1*b* and which are intended to form the core, are brought tangentially to this surface in line with the false twist spindle 6. The twist communicated by spindle 6 extends up along the yarn formed and confines the fibers coming from drawing system 1*a*.

According to the present invention, the fibers coming from system 1*b* for forming the core are, between the outlet of drawing system 1*b* and the guiding surface 4 where the formed core 7 is associated with the covering fibers 8, subjected to the action of a second condenser element generally designated by reference 9 and which is also in the form of a rotary guide 10 associated with a mobile roller 11 blocking the extension of twist communicated by the false twist spindle 6.

Figure 2:
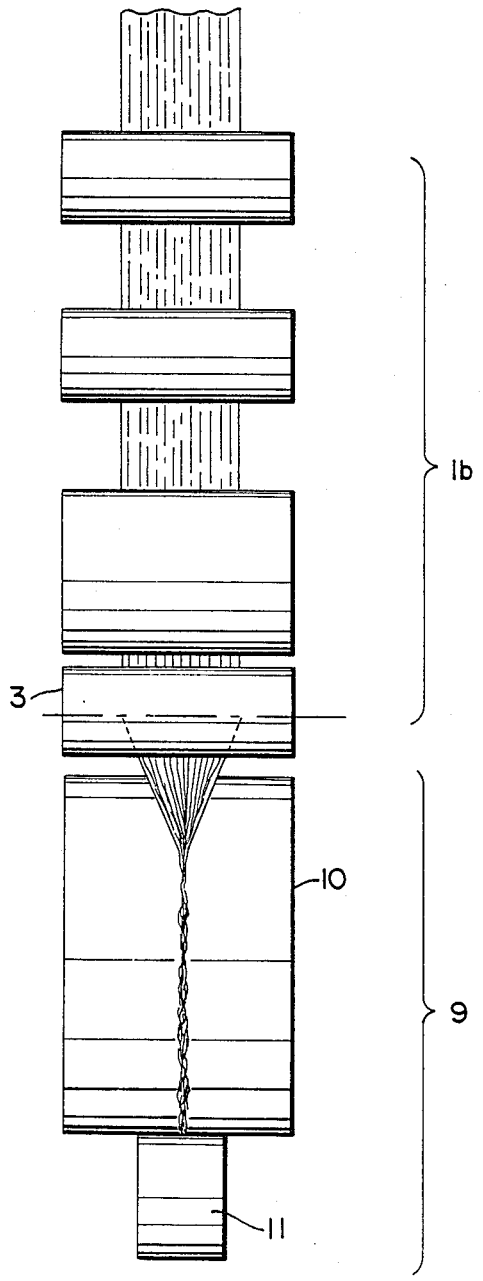
Figure 3:
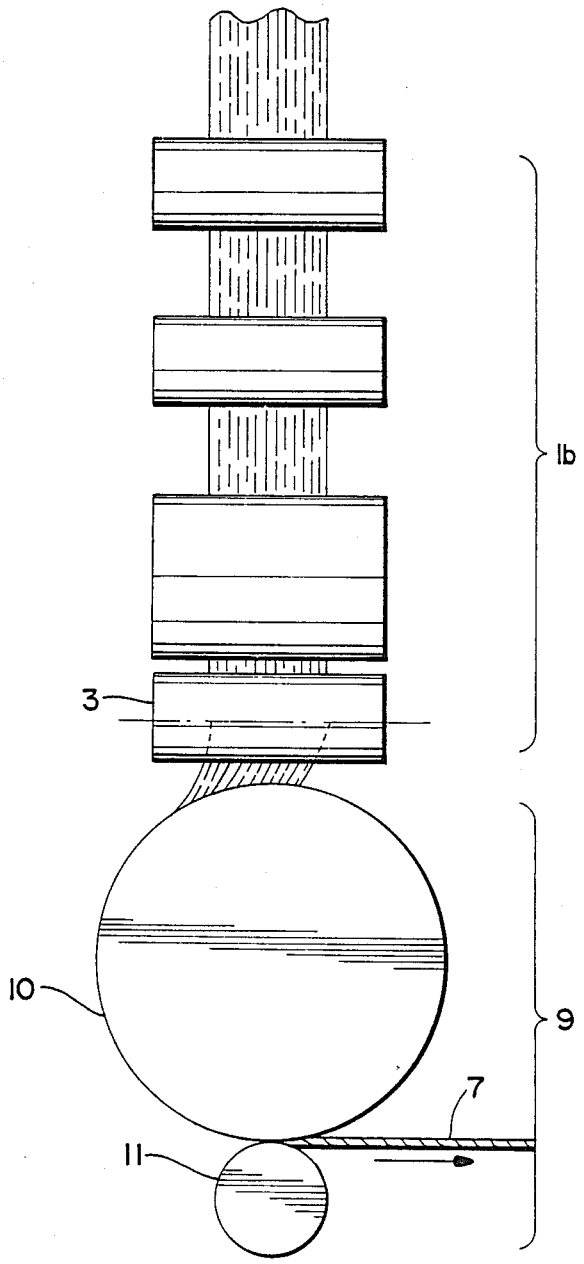
FIG. 3 illustrates a preferred variant embodiment of the invention according to which, for making the fibrous core, the condenser device provided with its twist blocking presser is offset by 90° with respect to the drawing system.
Figure 4:
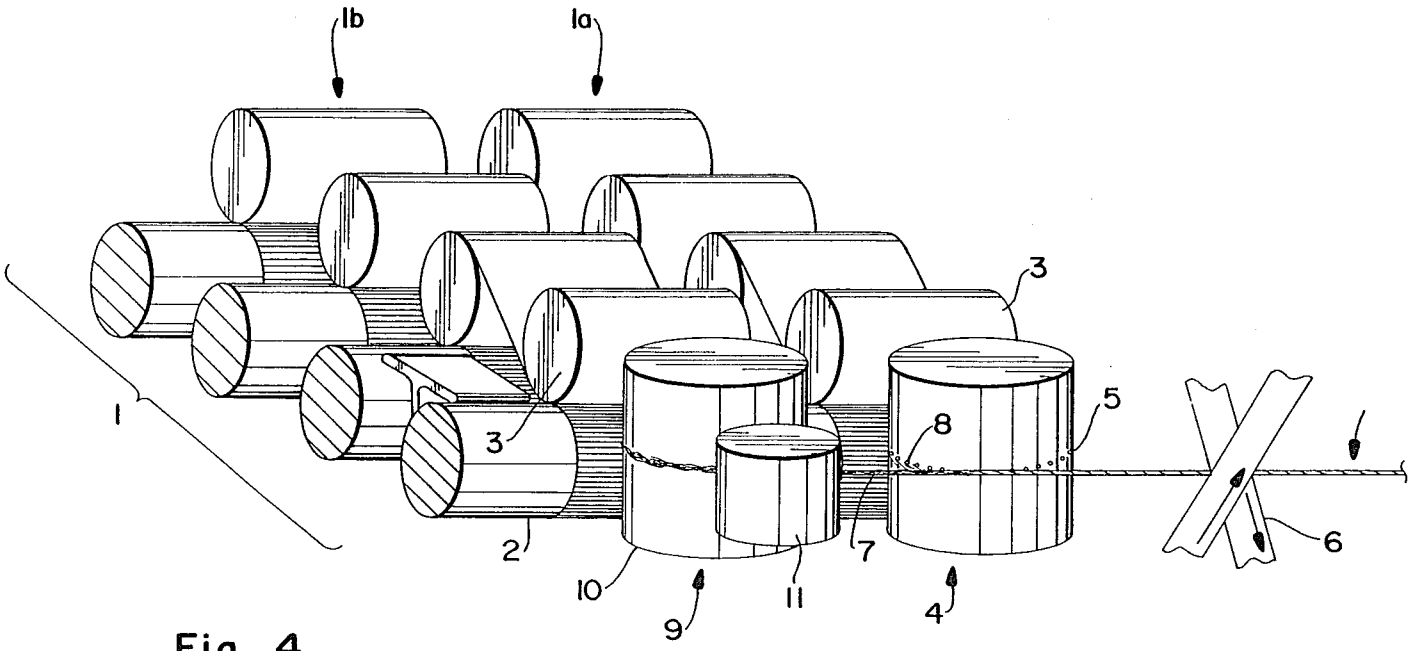
FIGS. 4 and 5 are views in perspective showing the whole of a device according to the invention in which the drawing trains are disposed substantially horizontally, the core and cover condensers being disposed at right angles to the outlet of the drawing system.
Figure 5:
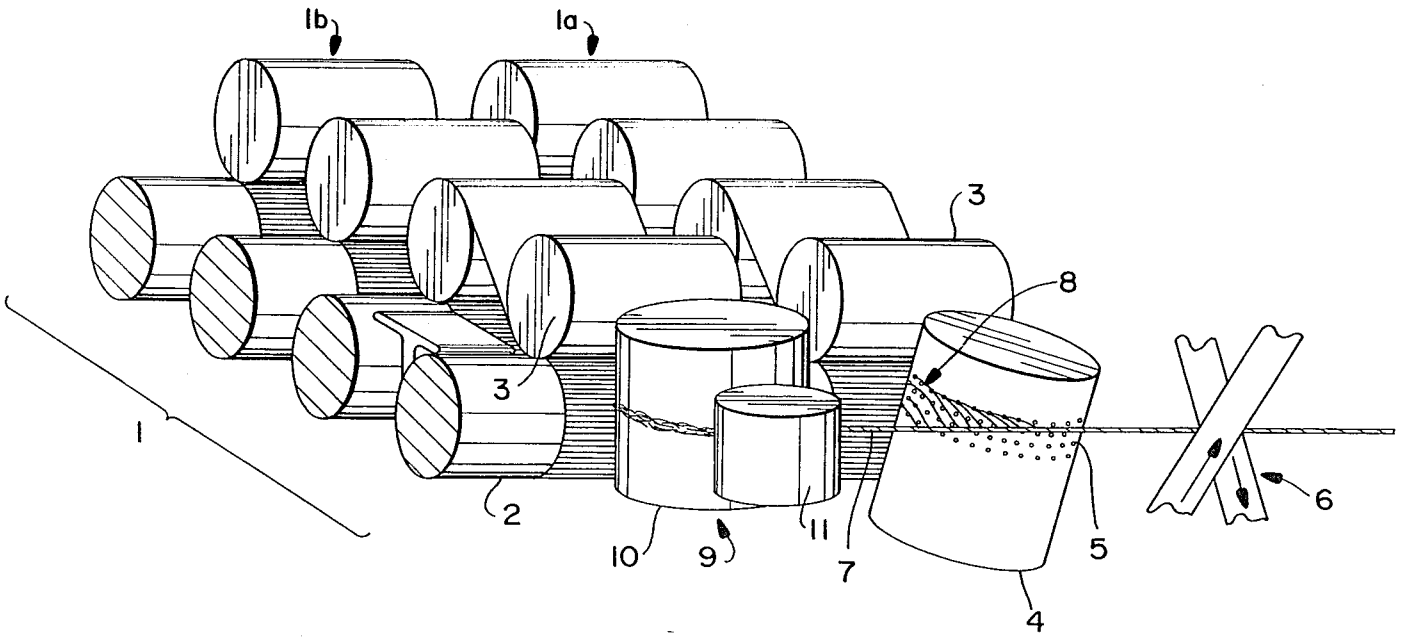
Figure 9:
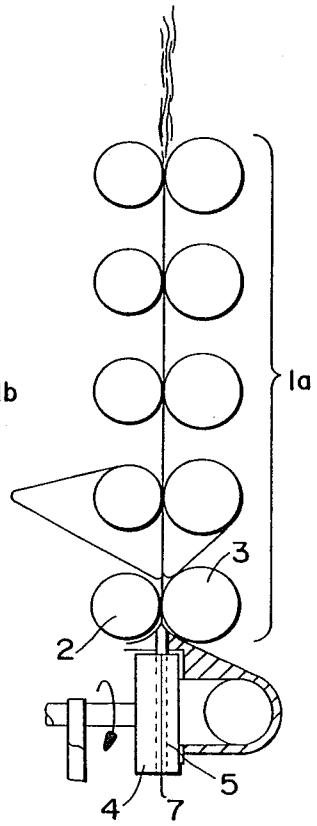
FIGS. 7, 8 and 9 are views in detail showing the embodiment of a device according to the invention as illustrated in FIG. 6, respectively in direction A (FIG. 7) and direction B (FIG. 8 showing the core condenser, FIG. 9 the delivery of the cover fibers).
Figure 8:
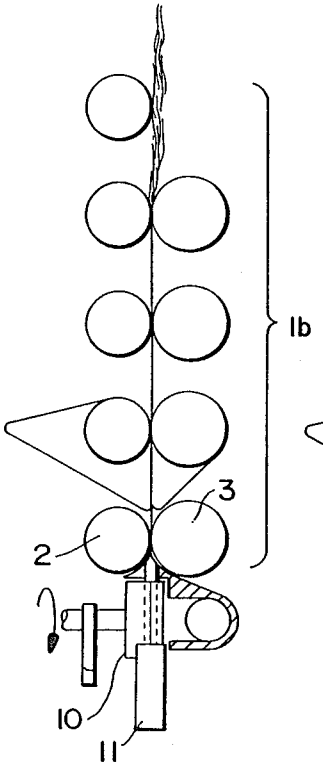
Figure 7:
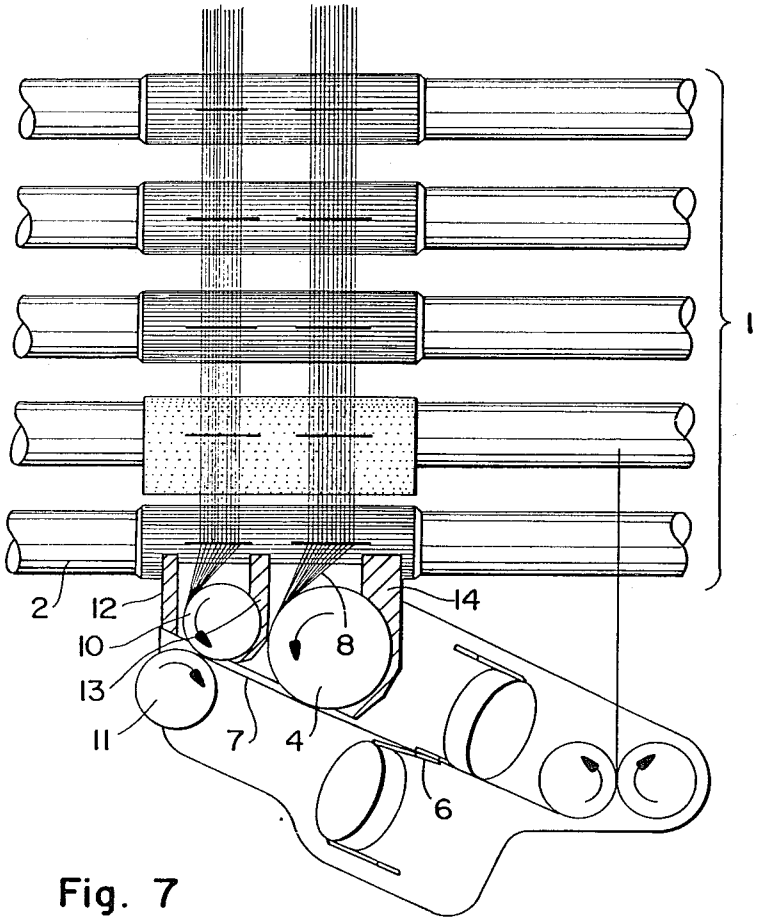
Figure 6:
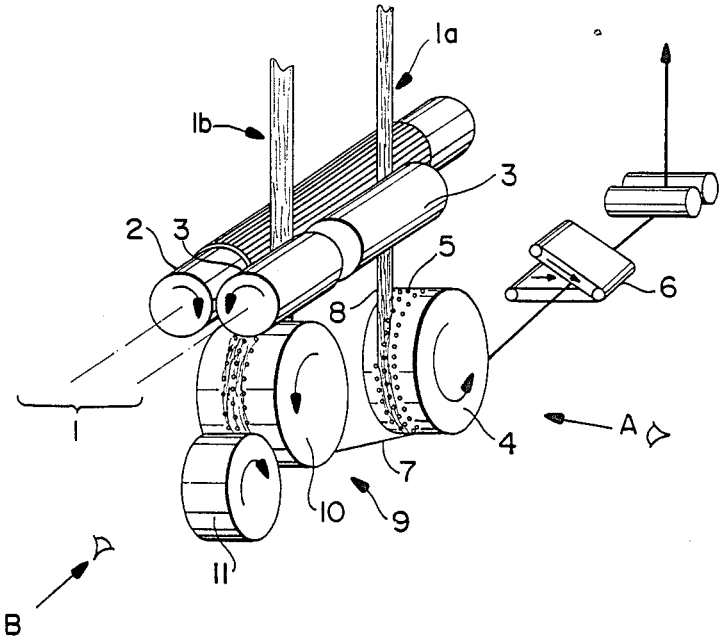
FIG. 6 is a schematic view in perspective showing a device according to the invention in which the drawing system is disposed vertically, the core and cover condensers also being disposed at right angles with respect to the outlet of said drawing system and therebelow.

Such an additional condenser element is illustrated in FIGS. 1, 2 and 3. The embodiment illustrated in FIG. 3, in which the condenser element is disposed at right angles to the outlet of the drawing train, is preferred.

Such a device presents numerous advantages over the teachings of French Pat. No. 2 560 230 (U.S. Pat. No. 4, 584,830), in that it enables more regular yarns to be obtained, in which the core spun yarn may be much finer. Furthermore, it is possible, as is clearly apparent from the embodiment illustrated in FIGS. 7 to 9, to make a very compact assembly in which the cover condenser element (element 4), the core condenser element 9, and the false twist spindle 6 are grouped together in a very small volume. In this arrangement, it is possible to provide separator elements 12, 13, 14 between the two condensers avoiding any loss of fibers. Finally, in such devices, it is easy to incorporate an additional core spun yarn, for example a continuous filament inside the fibrous core, this additional element being brought between the condenser element 9 and the presser roller 10.

What is claimed is:

1. A spinning installation for making a fiber spun yarn of the type comprising an internal core formed of discontinuous fibers, said core being covered with an external sheath also formed of discontinuous fibers, said spinning installation comprising:

a false twist spindle which subjects the fibers forming the inner core to a momentary false twist operation;

a movable guiding surface which projects elementary fibers onto the inner core upstream of the false twist spindle, said elementary fibers being tangentially delivered onto said movable guiding surface, said movable guiding surface having a tendency to exert a pulling force on a free end of said elementary fibers, said core being moved tangentially with respect to said guiding surface along a direction which the elementary fibers are moved by said guiding surface;

a common drawing system which draws both the fibers which will make up the internal core and the fibers which will make up the external sheath;

such that at an outlet of the drawing system, a first part of the drawn fibers is delivered onto the movable guiding surface, and a second part of said fibers is initially directed away from said movable guiding surface and then into tangential contact with the movable guiding surface downstream of the location where the first part of the fibers is delivered to the movable guiding surface, said first part of the fibers thereby forming the external sheath and said second part forming the internal core;

the installation also comprising a second movable guiding surface which contacts the fibers for forming the inner core between the common drawing system and the movable guiding surface, said second movable guiding surface comprising a rotating guide and a mobile roller, thereby blocking the extension back of twist communicated by the false twist spindle.

2. The installation of claim 1, wherein the rotating guide comprises a cylinder having orifices formed in a median part thereof, the orifices being connected to a source of suction.

3. The installation of claim 2, wherein the movable guiding surface and the second movable guiding surface are disposed at right angles to the outlet of the common drawing system.

4. The installation of claim 3, wherein the fibers coming from the common drawing system which are to form the core contact the second movable guiding surface over part of its peripery before contacting the mobile roller.

5. The installation of claim 4, wherein the common drawing system is disposed vertically, and the movable guiding surface and the second movable guiding surface are disposed horizontally below the outlet of the common drawing system.

6. A spinning installation for making a fiber spun yarn comprising an internal core formed of discontinuous fibers, the internal core being covered with an external sheath also formed of discontinuous fibers, the spinning installation comprising:

a common drawing system comprising a core sleeve system for drawing internal core fibers and a cover sleeve system for drawing external sheath fibers;

a guiding surface comprising a rotating cylinder around which the external sheath fibers are drawn and to which the internal core fibers are tangentially supplied;

a false twist spindle which subjects the internal core and the external sheath to a momentary false twist operation, the false twist spindle being positioned downstream from the guiding surface; and a condenser element comprising a rotary guide and a mobile roller, the condenser element being positioned between the core sleeve system and the guiding surface to block the extension back of twist communicated by the false twist spindle.

* * * * *